United States Patent [19]

Lewyllie et al.

[11] Patent Number: 4,898,214

[45] Date of Patent: Feb. 6, 1990

[54] METHOD AND APPARATUS FOR REMOVING AN IMPROPERLY INSERTED WEFT THREAD FROM AN AIR-JET LOOM

[75] Inventors: Dirk Lewyllie, Wervik; Jose Vangheluwe, Ypres; Bernard Pauwels, Roeselare; Henry Shaw, Vleteren, all of Belgium

[73] Assignee: Picanol N. V., Ypres, Belgium

[21] Appl. No.: 242,123

[22] Filed: Sep. 9, 1988

[30] Foreign Application Priority Data

Sep. 11, 1987 [DE] Fed. Rep. of Germany ..... 3730480

[51] Int. Cl.[4] ..... D03J 1/04

[52] U.S. Cl. ..... 139/116 A

[58] Field of Search ..... 139/116 R, 116 A, 429, 139/435, 452

[56] References Cited

U.S. PATENT DOCUMENTS 4,133,353 1/1979 Larmit ..... 139/435

4,756,341 7/1988 Takehana ..... 139/116 A 4,781,221 11/1988 Onishi et al. ..... 139/116 A

FOREIGN PATENT DOCUMENTS 2228131 12/1972 Fed. Rep. of Germany .

*Primary Examiner*—Henry S. Jaudon

*Attorney, Agent, or Firm*—Bacon & Thomas

[57] ABSTRACT

A method and apparatus to remove a defectively inserted weft thread includes preventing the severing of the weft thread from the ready supply of weft thread, releasing lengths of weft thread less than twice the width of the material from the ready supply of weft thread, blowing the released weft thread by pulsating blowing into the shed containing the defectively inserted weft thread, severing the newly inserted weft thread and the defectively inserted weft thread from the ready supply, and removing the weft thread from the shed by pulsating blowing of the weft thread.

24 Claims, 2 Drawing Sheets

METHOD AND APPARATUS FOR REMOVING AN IMPROPERLY INSERTED WEFT THREAD FROM AN AIR-JET LOOM

BACKGROUND OF THE INVENTION

The invention concerns a method and apparatus for removing an improperly inserted weft thread from an air-jet loom, wherein the individual wefts or picks are inserted by means of a main jet nozzle and auxiliary jet nozzles into a shed formed by warp threads, whereupon the wefts are beaten-up into the fell of the fabric and then cut from the supply of weft thread kept ready in the vicinity of the main jet nozzle. The weft thread insertion is monitored by a weft monitor mounted on the opposite side of the shed from the main jet nozzle. If the weft thread is defectively inserted into the shed and is not sensed by the weft monitor at the shed exit, the cutting of the defectively inserted weft is prevented and a program comprising a series of steps for error correction is initiated.

According to the program, the loom is either stopped in or stopped and moved to a position maintaining the shed with the improperly inserted weft thread. Thereafter a predetermined length of weft thread from a ready supply is introduced into the shed and is advanced together with the improperly inserted weft thread to the side of the shed opposite the main jet nozzle, after which the newly inserted length of weft thread is severed from the weft thread of the ready supply and, together with the improperly inserted weft thread, is removed from the shed on the side opposite the main jet nozzle.

In a known device and procedure of this kind (European Patent Publication No. 0 207 470), a predetermined length of weft thread about twice the normal length, i.e., the width of the fabric, is taken from the ready supply of weft thread and hangs adjacent the defectively inserted weft thread prior to its being blown into the shed. The predetermined length of weft thread is blown through the shed and arrives in the area of a catch means located on the side of the shed opposite the main jet nozzle. By means of the tensile force exerted by the catch means on the newly inserted length of weft and the defectively inserted weft thread, the defectively inserted weft thread is expected to be peeled off the fell of the fabric, with the tensile force applied to the defectively inserted weft thread being essentially transverse to the direction of the warp yarns.

It is also known (German Patent Publication No. DT 22 28 131) to reverse the loom in the event of a defectively inserted weft thread to a position where the auxiliary jet nozzles are activated and constantly blow out air because of the operative position to which the batten of the loom has been reversed. An ejector means then seizes the free end of the defectively inserted weft thread while it is still connected to the ready supply of weft thread and moves the end into the vicinity of the auxiliary jet nozzles. During this time the ready supply of weft thread is clamped to prevent additional weft thread from being taken from the supply by the ejector means moving the defectively inserted weft thread. Thereafter the defective weft thread is blown by the auxiliary jet nozzles and removed from the fell of the fabric. The clamp holding the ready supply of weft thread is released and newly inserted weft thread is blown together with the defectively inserted weft thread to the side of the fabric opposite the main jet nozzle where, following cutting, it is removed from the shed.

SUMMARY OF THE INVENTION

The object of the present invention is to provide a method and apparatus which makes it possible to remove, using relatively high forces, a defectively inserted weft thread (i.e., a mis-pick) from the fell of fabric, with such forces being essentially available over the entire length of the shed.

The object is achieved by a device that takes from the ready supply of weft thread several segments of predetermined length, each smaller than twice the width of the fabric, and in blowing these weft segments together with the defective weft thread through the shed by several jet pulses blown through the main jet nozzle and the auxiliary jet nozzles.

By the nozzles blowing several jet pulses the defective weft is pulled by the pulsating force of the pulses from the fell of the fabric. Relatively high detachment forces are possible by this method. The detachment forces can be repeatedly applied to the defective weft thread if it is not at first removed from the shed, and the forces may be applied over the entire length of the shed. In this manner a high reliability is achieved that a defective weft thread will actually be detached from the fell of the fabric and be removed from the shed at the side opposite the main jet nozzle.

In carrying out the invention, the presence of a new weft thread near the main jet nozzle is monitored before the corrective steps to remove the defective weft thread are initiated. This determines whether the corrective steps should be gone through or whether the absence of a weft thread at the shed exit is due to some other cause.

In a further embodiment of the invention, a predetermined length of the ready supply of weft thread is released after the weft monitor at the shed exit emits a signal of weft insertion defect. The length of weft is kept tensioned in the region between a main jet nozzle that moves along with a batten and the edge of the material. As a result, the defective weft thread is not pulled from its position in the shed as the batten moves back because the predetermined length of weft thread is made ready for this motion. Also, the loop formed by the predetermined length of weft thread taken from the ready supply is kept away from the vicinity of the shed to avoid tangling of the threads.

In a further implementation of the invention, the main jet nozzle blows in pulsations by being loaded with compressed air at time intervals made to correspond with the predetermined length of weft thread taken from the ready supply. Therefore, the main jet nozzle is reliably prevented from exerting excessive loads on the weft thread which might cause the thread to break or fray.

In still a further implementation of the invention, auxiliary jet nozzles arranged along the shed are sequentially loaded in groups with compressed air to blow the weft through the shed, with the time of the blowing sequence to move an inserted weft through the shed being different from the time of the blowing sequence to remove a defectively inserted thread. It may be safely assumed that the detachment of a defective weft thread from the fell of the material will require more time than the conventional blowing-in of a weft thread, therefore the former time sequences will run their courses more slowly.

In still a further implementation of the invention, the auxiliary jet nozzles will be fed with compressed air at least once, but may be fed more often to generate a pulsating force to move the weft after a segment of predetermined length has been taken from the ready supply and blown into the shed. Thereby, the defective weft thread is pulled by the pulsating blowing several times without a further length of weft thread being released from the ready supply and inserted into the shed.

In yet another implementation of the invention, a pneumatic weft catch means is mounted on the side of the shed away from the main jet nozzle and is turned on and off synchronously with the last group of auxiliary nozzles fed in the sequence. This pneumatic catch means thereby contributes to the pulsating pull on the defectively inserted weft thread.

In yet another implementation of the invention, the batten is advanced into the vicinity of the fell of the material after the sequence of pulsating blowing has taken place and moves the weft thread into a cutter located adjacent the main jet nozzle where the weft thread is severed. This operation of the batten avoids the necessity for an additional cutting means because the cutter available for normal operation is used in the weft removal operation.

During operation of the invention, the newly inserted weft thread is tested before it is severed from the ready supply to insure it has adequate length to reach the side of the shed away from the main jet nozzle. In the event a weft monitor at the exit of the shed determines the absence of the weft thread, the sequence of pulsating blowing is repeated or the air jet loom is turned off.

In yet another implementation of the invention, the auxiliary jet nozzles will be loaded with compressed air in one or more cycles following the cutting step. This procedure serves to definitively blow out the cut-off newly inserted weft thread together with the defective weft. Appropriately, the pneumatic catch means at the exit of the shed will be turned off and on together with the loading of the auxiliary jet nozzles in order to remove the cut-off weft. Thereby the weft catch means assists in the detachment and removal of the weft thread from the shed.

In yet another, implementation of the invention, the success in removing a defectively inserted weft thread will be checked by another weft monitor before the air jet loom is turned on again. In this manner the air jet loom checks itself and resumption of the operation in spite of an unattended defect will be impossible.

Further advantages and features of the invention will become clear from the drawings and the description below of an illustrative embodiment of an air jet loom comprising the apparatus of the invention whereby the method of the invention can be carried out.

DESCRIPTION OF THE PREFERRED EMBODIMENT

Air jet looms have been known for some time, both from literature and commercially available machinery, therefore a functional diagram of such a loom will suffice to adequately explain the present invention. Only those parts of the loom will be described and discussed in particular which differ from those of a conventional air jet loom.

Figure 1:
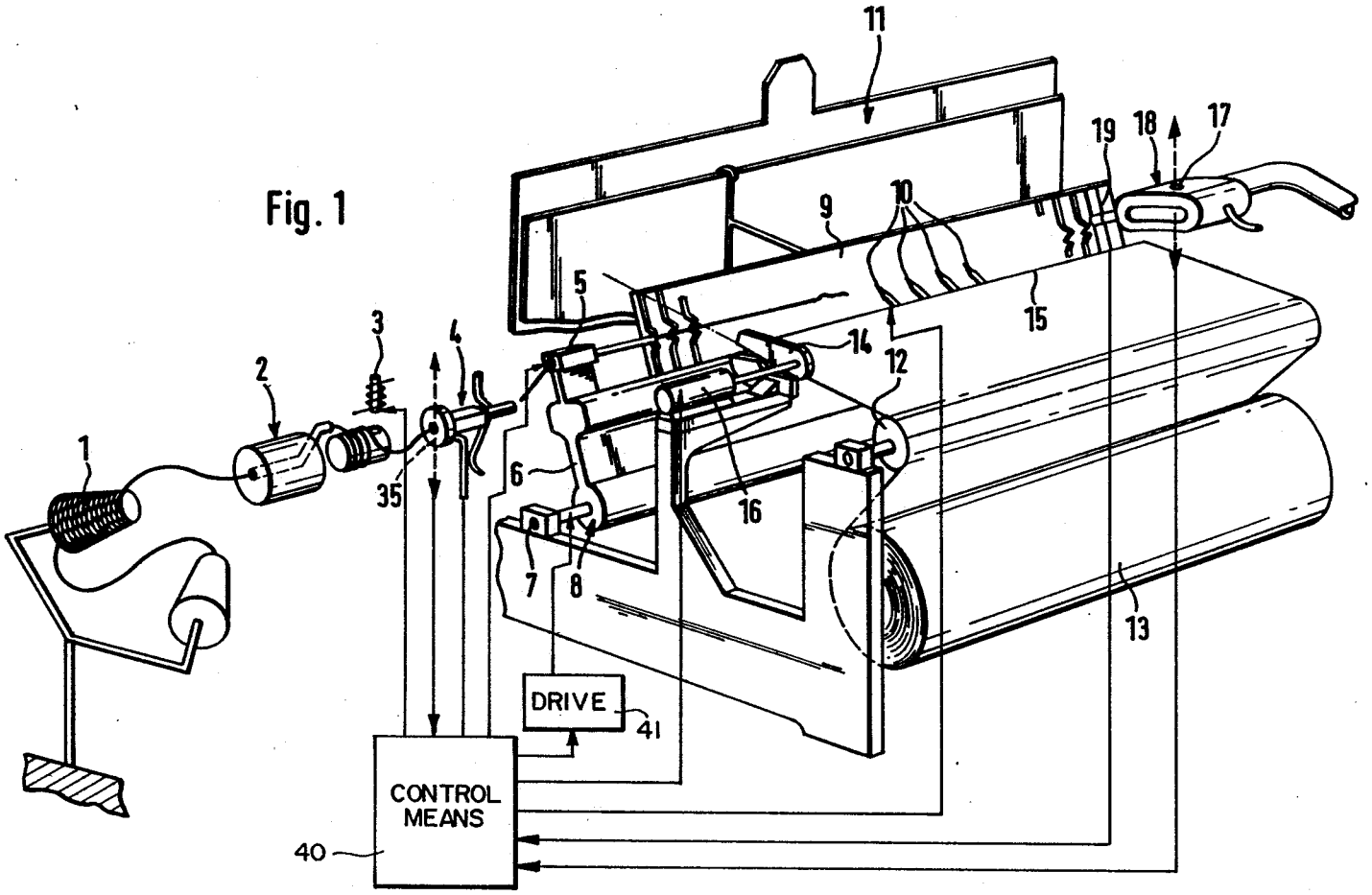
FIG. 1 is a perspective view of an air jet loom, only the essential elements being shown.

In the air jet loom shown in FIG. 1, the warp threads pass from a warp beam (omitted) over a whip roll (omitted) and splitting rods (omitted) to a shed-forming means 11. The shed forming means 11 forms sheds from the warps, and the weft threads are sequentially inserted into and through these sheds. The inserted weft threads are beaten by a reed 9 mounted on a batten 8 up into the fell 15 of the material. The finished material is removed by a removal means 12 shown schematically and is wound on a warp beam 13.

Figure 4:
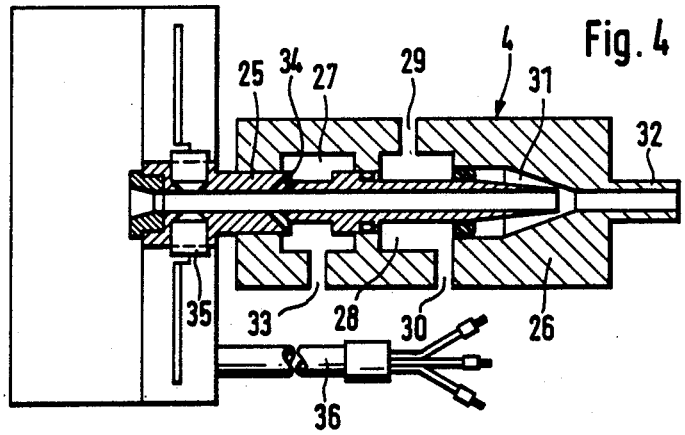
FIG. 4; is a detail of the main nozzle assembly of the air jet loom of FIG. 1, where the loom includes a pre-blow (auxiliary) nozzle preceding the main jet nozzle.

The weft threads are moved by air in an air jet loom into the particular sheds. The wefts are moved into position from a bobbin 1 from which they are drawn by a coiling device 2 and are kept ready in the form of coils. One length of weft thread that is approximately the width of the fabric, corresponds to a number of turns of the coiling device 2, that is three or four turns or the like. A magnetic clamp 3 is associated with the coiling device 2, whereby the readied weft thread can be clamped or released. The coiling device 2 is followed by a stationary pre-blow nozzle 4 which shall be discussed in further detail below in relation to FIG. 4. The pre-blow nozzle 4 is connected in a manner not shown in further detail by magnetic valves to a source of compressed air of which the control is elucidated below. The pre-blow nozzle 4 is followed by a main jet nozzle 5 mounted on the batten beam 6 of the batten 8. The batten 8 is driven into oscillating motion about a spindle 7 transverse to the loom. In the path of projection from the main jet nozzle 5, the blades of the reed 9 are provided with a U-shaped duct receiving laterally the air flow from the main jet nozzle 5. A plurality of auxiliary jet nozzles 10 are mounted on the batten beam 6 of the batten 8 and are directed to blow in the direction of motion of the weft thread through the U-shaped duct of the blades of the reed 9. A weft monitor 19 is present at the end of the reed 9 and monitors the presence of the inserted weft thread. In order to insert a weft thread, the clamping means 3 is opened for a predetermined time so that a predetermined number of turns of the weft thread will be drawn off the spool device 2, the number of turns corresponding to the length of weft thread to be inserted into the shed. The weft insertion takes place while the batten 8 moves forward, that is, while the reed 9 moves toward the fell 15 of the material. At the end of this motion, the newly inserted weft thread is beaten by the reed 9 into the material fell 15, and the weft thread is moved between the scissors 14 which sever the inserted weft thread from the weft thread extending from the main jet nozzle 5. The scissors 14 consist of a fixed blade and a movable blade driven in reciprocating motion by an electric motor 16. It should be noted that the auxiliary jet nozzles 10 are sequentially loaded with compressed air in groups in the direction of advance of the weft thread through the shed, the sequence of the group-wise actuation being matched to the desired speed for weft insertion.

As is implied by the above description of the embodiment FIG. 1, the operation of the various elements is interrelated, and thus a control means 40, including drive 41, must be provided. Based on the above description, implementation of such control means would be well within the capabilities of those skilled in the art.

Where the main jet nozzle 5 is conventional and known, the pre-blow nozzle 4 is a special design for the operation to be discussed below. The pre-blowing nozzle 4 shown in FIG. 4 comprises a tubular feedthrough duct 25 mounted in a housing block 26. The housing block 26 comprises two annular chambers 27 and 28 connected by magnetic valves (not shown) to a source of compressed air (not shown). The annular chamber 28 is connected by two hook-ups 29 and 30 through magnetic valves (not shown) to the compressed air source. Thereby the annular chamber 28 may be exposed on one hand to the full jet air pressure and on the other to a pressure significantly lower than the full jet air pressure and adequate to merely put tension on the weft thread. The duct 25 issues into an injector nozzle 31 communicating with the annular chamber 28. A flow of suction air is generated by this injector nozzle 31 in the duct 25 whereby the weft thread is subjected to the suction and is pulled through the duct 25 and then is blown out of a tube stub 32. The annular chamber 27 is connected by the compressed-air connector 33 through a magnetic valve (not shown) to the compressed air source (not shown). The duct 25 comprises boreholes 34 sloping in an opposite direction relative to the normal direction of travel of the weft thread in the region of the annular chamber 27. These boreholes allow blowing a jet of air into the duct 25 opposite to the normal direction of travel of the weft thread. The blowing pressure is adjustable by means of a control valve (not shown). The intake zone of the duct 25 facing the coiling device 2 is equipped with an optical weft monitor 35 connected by a hook-up cable 36 to a control means (not shown).

Figure 2:
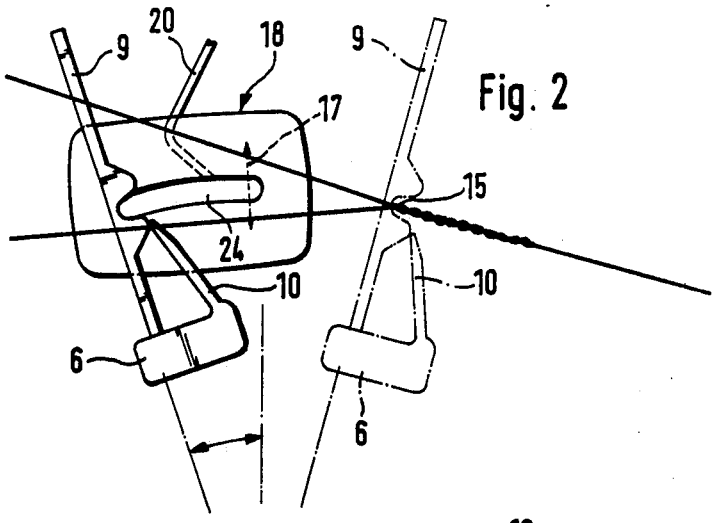
FIG. 2 is an elevation view of a detail of the side of the air jet loom opposite the main jet nozzle and in the direction of weft travel through the shed.
Figure 3:
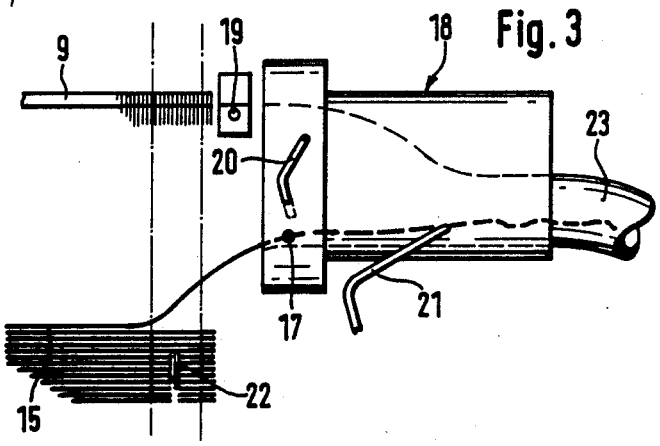
FIG. 3 is a plan view of the detail of FIG. 2.

A pneumatic weft catch means 18 is mounted on the side of the shed opposite the main jet nozzle 5 and points a slot 24 toward the zone of the shed. As shown by FIG. 2, the slot 24 extends in the direction of travel of the reed 9, and is located at the level of the U-shaped channel of the reed blades. FIG. 2 further shows that the slot extends approximately in the direction corresponding to the path of travel of the U-shaped channel of the reed blades of the reed 9 which is a circular path about the batten spindle 7. As shown by FIGS. 2 and 3, the slot 24 extends approximately across half the possible travel distance of the reed 9, starting at the reed's rear dead (i.e., dwell) point.

A duct tapering toward a drain line 23 joins the slot 24. Blow nozzles 20, 21 connected by magnetic valves (not shown) to a source of compressed air issue into the duct. Another weft monitor 17 is mounted near the end of the slot 24 facing the fell 15 of the material and will be further discussed further below. The blow nozzle 20 blows the weft thread in the vicinity of the catch means 18 toward the weft monitor 17 and also pulls the end of the weft into the catch means. The blow nozzle 21 also essentially points away from the slot 24, and pulls in tension on the weft thread in its vicinity.

The method of the invention will now be discussed in relation to the occurrence of a defect in the insertion of a weft thread. The individual operations, including the actuation of the entire loom, are driven by a control means containing a microprocessor whereby the individual elements may be driven, and the drive means may be actuated at predetermined as well as at adjustable times, these times being also variable in regard to their frequency.

Once the weft monitor 19 at the exit of the shed determines that a weft thread is absent from its zone, a corresponding signal is fed to the central control. This signal triggers the process steps listed below, which may be controlled by a microprocessor. First the electric motor 16 of the scissors 14 is actuated in such a way that no cutting shall take place, that is, the defectively inserted weft thread remains connected to the ready supply of weft. The clamp 3 of the spool device 2 is actuated in such a way that one turn of the ready supply of weft thread is drawn- of-f. This take-off is implemented by the pre-blow nozzle 4 and the main jet nozzle 5 being loaded at reduced air pressures in the normal blowing direction to assist in removing weft thread from the coil. Thereafter the supply of reduced pressure compressed air supplied to the pre-blow nozzle 4 and the main nozzle 5 is cut off, while the annular chamber 27 of the pre-blow nozzle 4 is loaded with compressed air. In this way the weft thread end between the defectively inserted weft thread and the main jet nozzle 5 is tensioned and as a weft thread loop is formed between the pre-blow nozzle 4 and the coiling device 2. The magnitude of the pressures and/or the duration of blowing-in are adjustable by means of a valve (not shown).

The error signal emitted by the weft monitor 19 also triggers shutdown of the loom. It is possible however that the loom may not be shut down sufficiently rapid such that the defectively inserted weft thread could still be beaten against the exposed fell of the material. Therefore the loom is shut down in a predetermined position, for instance at 120° of its operative cycle. Thereafter the defective weft is exposed again by newly forming the shed which was made available for its insertion. This may be carried out by reversing the loom correspondingly. However the loom also might be equipped with a special control which drives the loom into a weft thread seek-position, this is especially applicable when the individual units of the air jet loom are driven by individual motors. The batten 8 with the auxiliary jet nozzles 10 are moved back by reversing the loom to the extent that the blow apertures of the auxiliary nozzles 10 just protrude into the shed. This prevents the defective weft thread from catching on the auxiliary jet nozzles during the removal of the weft described below, or the catching of a newly inserted weft on the nozzles. This is a position somewhat deviating from the normal weft insertion position because dynamic conditions also must be taken into account when the weft threads are inserted normally. The position of the auxiliary nozzles to remove the weft thread defect corresponds to about 60° of the loom cycle, while the normal position of the nozzles to insert the weft thread is at about 80° of the loom operative cycle.

The above process steps terminate the preparations to remove the defectively inserted weft thread. However one operational check remains to be carried out, in particular that the signal from the weft monitor 19 indicating the absence of a weft thread exiting the shed is actually due to a defectively inserted weft thread. In particular, the vicinity of the pre-blow nozzle 4 is examined for the presence of weft thread to determine if the absence of a weft thread exiting the shed was due to the absence of weft thread at the pre-blow nozzle. The yarn monitor 35 carries out the monitoring of the presence of a readied weft thread in the zone of the pre-blower nozzle 4.

Once it has been ascertained that a weft thread is kept ready in the zone of the pre-blow nozzle, the program to remove the defectively inserted weft thread from the shed is carried out. To that end, the clamping means 3 releases at least another turn of the weft thread which then is blown into the shed by turning-on the pre-blow nozzle and the main jet nozzle. Before the weft thread is blown into the shed the counter-air from the pre-blow nozzle 4 will have been turned off. The pre-blow nozzle and the main jet nozzle 5 are driven at full output, that is, at the operating pressure of the compressed air, however the time of blowing is less than for normal operating conditions. The blowing time is matched to the predetermined length of the weft thread to be blown-in. Because one turn already had been taken from the coiling device 2 in the preparation to remove the defective weft, presently there are, following blowing in, at least two turns of the newly inserted weft thread in addition to the defectively inserted weft thread in the shed. Together with turning on the pre-blower nozzle 4 and the main jet nozzle 5, the auxiliary jet nozzles 10 also are turned on in their conventional staggered sequence, that is, they are loaded in groups with compressed air sequentially in the direction of weft travel. Because one must expect that the Z-shaped form of the weft thread between the fell of the material and the newly blown-in weft thread will not move as fast through the shed as an ordinary inserted weft thread, the invention provides that the time sequence of actuating the sequential groups of auxiliary jet nozzles 10 be reduced relative to the normal time sequence. Both the blowing time of the pre-blower nozzle 4 and of the main jet nozzle 5 and the time sequence of actuating the auxiliary jet nozzles can be adjusted, whereby these parameters can be matched to the particular material being processed. By actuating the pre-blower nozzle 4 and the main jet nozzle 5 and the auxiliary jet nozzles 10, the predetermined length of weft thread will be blown-in, and the defectively inserted weft thread still present near the fell of the material will be pulled on by the pulsating force the blowing nozzles exert on the weft thread.

Following the above described first step, the auxiliary nozzles 10 are once more loaded with compressed air in one or more cycles, whereby the auxiliary jet nozzles 10 once more exert a pulsating force on the Z-shaped form of the newly inserted and defectively inserted weft thread. The sequence of loading the groups of auxiliary jet nozzles may be the same as in the first step or, where called for, may be somewhat slowed down. The number of these attempts at detachment generated solely by the auxiliary jet nozzles and relating to the defectively inserted weft thread is adjustable and furthermore may also be matched to the particular material being processed. When a material is being processed in which a defectively inserted weft thread may be detached comparatively easily from the fell of the material, then possibly this particular process step may be dispensed with.

In the next step, the clamping means 3 is actuated to remove at least another turn of weft thread from the coiling device 2. As much of the ready supply of weft thread is removed until the newly inserted weft thread with the defectively inserted weft thread is long enough to reach across the width of the material to the zone of the pneumatic catch means 18 mounted on the side of the material away from the main jet nozzle 5. Because the catch means weft monitor 17, the operation of which shall be elucidated below, is mounted farther away from the material than the weft monitor 19, one more turn must be detached off the spool coiling device 2 than if the weft thread length were normal. It may happen that following these steps, the newly inserted weft thread has fully detached the defectively inserted weft thread and together they were received in the pneumatic catch means 18. However it is possible also that the defectively inserted weft thread still adheres to the fell 15 of the material, and that therefore further pulsating pulling by actuating the auxiliary jet nozzles 10 will be required. Again this depends on the material to be woven and adjustments can be made in relation to that material. It is to be noted that the total weft thread length required from the ready supply of weft thread can be released in one or more steps, that is, several turns may be released at once or they may be released sequentially.

The moment the weft thread enters the catch means 18, it is pulled by the blowing of the nozzle 20. The compressed-air loading through the nozzle 21 of the weft catch means 18 is also turned on in pulsations, whereby the weft catch means 18 also contributes to the pulsating pulling on the defectively inserted weft thread. Provision is made so that the weft thread catch means 18 is jointly turned on and off with the last group of auxiliary jet nozzles 10 loaded in the sequence. Following the end of the pulsating blowing loading cycles, the pneumatic catch means 18 remains on, while the auxiliary jet nozzles 10 will be turned off again.

Following a sufficient number of pulsating loadings, the air jet loom is moved into a given position forward, that is, in a position near the beat-up position, i.e., illustratively the position at 20° of its operative cycle. Thereby the weft thread still connected to the main jet nozzle 5 will be inserted into the scissors 14 which then are actuated, whereby the weft thread is cut off. During this motion the reed 9 moves the weft thread into a monitored position, i.e., into the zone of the weft monitor 17 located at the end of the slot 24 of the catch means 18. Prior to cutting, the weft monitor 17 makes sure that a weft thread indeed did enter the yarn catch means. If otherwise, either the attempt at detachment will be repeated, or the air jet loom is stopped.

Following the cutting-off procedure, the loom is reset, whereby the auxiliary jet nozzles 10 again extend into the shed as far as they do when the loom is positioned at 60° of its operative cycle. Thereupon the auxiliary jet nozzles 10 are again loaded with several sequences of compressed air in order to definitively remove from the shed the cut off newly inserted weft thread together with the defective weft thread. The pneumatic catch means (18) is driven in this process in synchronization with the blowing sequence of the last group of auxiliary jet nozzles. It is found in this regard that as a rule, the operation to remove the cut weft will be adequate with four cycles of compressed air loading of the auxiliary jet nozzles 10 and the catch means 18.

After this blowing-out procedure, the air jet loom once more is moved into a monitoring position, namely a position wherein the reed 9 would return any weft thread still in the shed to the zone of the yarn monitor 17. If the yarn monitor 17 finds there is no weft thread present, the air jet loom is returned to its starting position whereupon the weaving resumes. If the yarn monitor 17 in this procedure should determine that a weft thread is still present, then either the attempts to detach the defectively inserted weft thread will be repeated by actuating the auxiliary jet nozzles 10 and the catch means 18, or the loom is switched to the malfunction mode so that an operator may be called to remedy the defect.

We claim:

1. A method for removing a defectively inserted weft thread from a fabric fell in a fluid jet loom of the type wherein:

a length of weft thread normally is taken from a ready supply of weft thread and is inserted by being blown by a main jet nozzle into a first end of a shed formed from warp threads of the fabric, the inserted weft thread is blown through the shed by auxiliary jet nozzles arranged along the shed, the inserted weft thread is detected at a second end of the shed by a weft monitor located on the opposite side of the shed from the main nozzle, and the inserted weft thread is beaten-up into the fabric fell and severed from the ready supply at a point adjacent the main nozzle, the method comprising the steps of:

preventing the severing of the weft thread when the weft thread is defectively inserted into the shed and not detected by the monitor;

stopping the operation of the loom in a position that forms the shed into which the weft thread is defectively inserted;

taking predetermined lengths of weft thread from the ready supply sequentially in several length segments, each segment being shorter than twice The width of the fabric, and blowing each segment through the shed together with the defectively inserted weft thread by using several sequential jet pulses from the main jet nozzle and the auxiliary jet nozzles.

2. The method as claimed in claim 1 wherein, when an inserted weft thread is not detected by the weft monitor, the predetermined length of weft thread taken from the ready supply is kept in tension between the main jet nozzle and the fabric fell.

3. The method as claimed in claim duration of the jet pulses blown by the main nozzle is proportional to the predetermined length of weft thread to be blown into the shed.

4. The method as claimed in claim 1 wherein the several sequential jet pulses blown from the auxiliary nozzles to remove a defectively inserted weft thread from the shed are blown in a time sequence different from the time sequence of jet pulses blown during normal operation of the loom.

5. The method as claimed in claim 1 wherein the several sequential jet pulses blown from the auxiliary jet nozzles are repeated a predetermined number of times to produce a pulsating force on the defectively inserted weft thread.

6. A method for removing a defectively inserted weft thread from a fabric fell in a fluid jet loom of the type wherein:

a length of weft thread normally is taken from a ready supply of weft thread, is inserted by being blown by a main jet nozzle into a first end of a shed formed from warp threads of the fabric, the inserted weft thread is blown through the shed by auxiliary jet nozzles arranged along the shed, the inserted weft thread is detected at a second end of the shed by a weft monitor located on the opposite side of the shed from the main jet nozzle, and the inserted weft thread is beaten-up into the fabric fell and severed from the ready supply at a point adjacent the main nozzle, the method comprising the steps of:

preventing the severing of the weft thread when the weft thread is defectively inserted into the shed and not detected by the weft monitor;

stopping the operation of the loom in a position that forms the shed into which the weft thread is defectively inserted;

taking predetermined lengths of weft thread from the ready supply sequentially in several length segments, and blowing each segment through the shed together with the defectively inserted weft thread by using several sequential jet pulses from the main jet nozzle and the auxiliary jet nozzles the method as claimed in claim 1 wherein, when an inserted weft thread is not detected by the weft monitor, the predetermined length of weft thread taken from the ready supply is kept in tension between the main jet nozzle and the fabric fell by a pre-blow nozzle that projects weft thread into the main nozzle, the pre-blow nozzle selectively blowing the weft thread in a direction opposite to the direction of blowing when projecting weft thread into the main jet nozzle when an inserted weft thread is not detected by the weft monitor.

7. A method for removing a defectively inserted weft thread from a fabric fell in a fluid jet loom of the type wherein:

a length of weft thread normally is taken from a ready supply of weft thread and is inserted by being blown by a main jet nozzle into a first end of a shed formed from warp threads of the fabric, the inserted weft thread is blown through the shed by auxiliary jet nozzles arranged along the shed, the inserted weft thread is detected at a second end of the shed by a weft monitor located on the opposite side of the shed from the main nozzle, and the inserted weft thread is beaten-up into the fabric fell and severed from the ready supply at a point adjacent the main nozzle, the method comprising the steps of:

preventing the severing of the weft thread when the weft thread is defectively inserted into the shed and not detected by the weft monitor;

stopping the operation of the loom in a position that forms the shed into which the weft thread is defectively inserted;

taking predetermined lengths of weft thread from the ready supply sequentially in several length segments, and blowing each segment through the shed together with the defectively inserted weft thread by using several sequential jet pulses from the main jet nozzle and the auxiliary jet nozzles, wherein, when an inserted weft thread is not detected by the weft monitor, a second weft monitor determines whether the weft thread i present at the main jet nozzle.

8. The method as claimed in claim 7 wherein a pneumatic weft catch means at the opposite end of the shed from the main jet nozzle is turned on and off sequentially to blow the inserted weft thread from the second end of the shed into the catch means.

9. The method as claimed in claim 8 wherein the catch means is turned on synchronously with the last sequential jet pulses blown from the auxiliary jet nozzles.

10. The method as claimed in claim 8 wherein, following the several sequential jet pulses blown from the main jet nozzle and the auxiliary jet nozzles, a batten is advanced toward the fabric fell to move the inserted weft thread into a cutter adjacent the main jet nozzle and cutting the inserted weft by the cutter.

11. The method as claimed in claim 10 wherein, before the cutter cuts the predetermined length of weft thread from the ready supply of weft thread, detecting by a third weft monitor in the pneumatic catch means whether the defectively inserted weft thread has been blown into the catch means by detecting the presence of the weft thread at the third weft monitor.

12. The method as claimed in claim 11 wherein, when the third weft monitor detects that the defectively inserted weft thread has not been blown into the catch means, several sequential jet pulses are again blown through the auxiliary nozzles.

13. The method as claimed in claim 11 wherein, when the third weft monitor detects that the defectively inserted weft thread has not been blown into the catch means, an additional predetermined length of weft thread is taken from the ready supply of weft thread and is blown together with the previously taken predetermined length of weft thread and the defectively inserted weft thread through the shed by several sequential jet pulses blown from the main jet nozzle and the auxiliary jet nozzles.

14. The method as claimed in claim 7 wherein, following the several sequential jet pulses blown from the main jet nozzle and the auxiliary jet nozzles, a batten is advanced toward the fabric fell to move the inserted weft thread into a cutter adjacent the main jet nozzle and thereafter the inserted weft thread is cut by the cutter.

15. The method as claimed in claim 14 wherein, following the cutting of the weft thread, the predetermined length of weft thread taken from the ready supply together with the defectively inserted weft thread are blown out off the shed and the fabric fell by several sequential jet pulses blown from the auxiliary jet nozzles.

16. The method as claimed in claim 15 wherein a third weft monitor is provided and determining by the third weft monitor whether the predetermined length of weft thread and the defectively inserted weft thread have been successfully removed from the shed before permitting the air jet loom to restart.

17. The method as claimed in claim 16 wherein a reed advances with the batten and moves any weft remaining in the shed to a position where it is detected by the third weft monitor.

18. The method as claimed in claim 15 wherein a pneumatic catch means at the opposite side of the shed from the main jet nozzle is turned on and off synchronously with the last sequential jet pulses blown from the auxiliary jet nozzles.

19. The method as claimed in claim 18 wherein, following the cutting of the weft thread and the blowing of the length of the weft thread and the defectively inserted weft thread out of the shed, using a third weft monitor located in the catch means to determine whether there is a weft thread left in the shed before restarting the loom.

20. A fluid jet loom with a means for removing a defectively inserted weft thread from a fabric fell comprising:

a means providing a ready supply of weft thread;

a main jet nozzle arranged to receive a predetermined length of weft thread from said ready supply means, and to insert said said length of weft thread into a first end of shed formed from warp threads of the fabric;

a transfer means associated with said ready supply means and said main nozzle and arranged to take up a predetermined length of weft thread from said ready supply means and transfer it to said main nozzle;

auxiliary jet nozzles arranged along the shed to blow the inserted length of weft thread through the shed;

a first weft monitor located at a second end of the shed opposite said main jet nozzle and arranged to detect a defectively inserted weft thread by detecting the absence of an inserted weft thread at the second end of the shed;

a beat-up means arranged to beat-up an inserted weft thread into the fabric fell;

a cutting means adjacent said main jet nozzle and arranged to cut the beat-up weft thread from the ready supply;

a control means for preventing said cutting means from cutting the beat-up weft thread in response to the monitor detecting a defectively inserted weft thread;

said control means including a stopping means arranged to stop the operation of the loom in a position that forms the shed into which the weft thread is defectively inserted in response to the weft monitor detecting a defectively inserted weft thread;

and said control means further including associated with said ready supply means, said transfer means, said main jet nozzle and said auxiliary jet nozzles to control said ready supply means to release a predetermined length of weft thread supply sequentially in several length segments, each segment being shorter than twice the width of the fabric to control said transfer means to take up each segment of weft thread to control said main jet nozzle to insert each segment of weft thread into the shed and to control said auxiliary jet nozzles to blow each inserted segment together with the defectively inserted weft thread through the shed in response to the weft monitor detecting a defectively inserted weft thread; and a second weft monitor arranged to detect a weft thread blown through the shed.

21. A fluid jet loom as claimed in claim 20 further comprising:

a pneumatic weft catch means arranged at the opposite side of the shed from said main jet nozzle to receive an inserted weft thread blown through the shed.

22. A fluid jet loom with a means for removing a defectively inserted weft thread from a fabric fell comprising:

a means providing a ready supply of weft thread;

a main jet nozzle arranged to receive a predetermined length of weft thread from said ready supply means, and to insert said length of weft thread into a first end of a shed formed from warp threads of the fabric;

a transfer means associated with said ready supply means and said main nozzle and arranged to take up a predetermined length of weft thread from said ready supply means and transfer it to said main nozzle;

auxiliary jet nozzles arranged along the shed to blow the inserted length of weft thread through the shed;

a first weft monitor located at a second end of the shed opposite said main jet nozzle and arranged to detect defectively inserted weft thread by detecting the absence of an inserted weft thread at the second end of the shed;

a beat-up means arranged to beat-up an inserted weft thread into the fabric fell;

a cutting means adjacent said main jet nozzle and arranged to cut the beat-up weft thread from the ready supply;

a control means for preventing said cutting means from cutting the beat-up weft thread in response to the weft monitor detecting a defectively inserted weft thread;

said control means including a stopping mans arranged to stop the operation of the loom in a position that forms the shed into which the weft thread is defectively inserted in response to the weft monitor detecting a defectively inserted weft thread;

and said control means being associated with said ready supply means, said transfer means, said main jet nozzle and said auxiliary jet nozzles to control said transfer means to take up a predetermined length of weft thread from said ready supply sequentially in several length segments, to control said main jet nozzle to insert each segment of weft thread into the shed, and to control said auxiliary jet nozzles to blow each inserted segment together with the defectively inserted weft thread through the shed in response to the weft monitor detecting a defectively inserted weft thread, said transfer means comprising a third weft monitor arranged to detect weft thread transferred to said main jet nozzle.

23. A fluid jet loom as claimed in claim 22 further comprising:

a pneumatic weft catch means arranged at the opposite side of the shed from said main jet nozzle to receive an inserted weft thread blown through the shed, the catch means including said second weft monitor arranged to detect a weft thread blown through the shed into the catch means.

24. A fluid jet loom with a means for removing a defectively inserted weft thread from a fabric fell comprising:

a means providing a ready supply of weft thread;

a main jet nozzle to receive a predetermined length of weft thread from said ready supply means, and to insert said length of weft thread into a first end of a shed formed from warp threads of the fabric;

a transfer means associated with said ready supply means and said main nozzle and arranged to take up a predetermined length of weft thread from said ready supply means and transfer it to said main nozzle;

auxiliary jet nozzles arranged along the shed to blow the inserted length of weft thread through the shed;

a first weft monitor located at a second end of the shed opposite said main jet nozzle and arranged to detect a defectively inserted weft thread by detecting the absence of an inserted weft thread at the second end of the shed;

a beat-up means arranged to beat-up an inserted weft thread into the fabric fell;

a cutting means adjacent said main jet nozzle and arranged to cut the beat-up weft thread from the ready supply;

a control means for preventing said cutting means from cutting the beat-up weft thread in response to the weft monitor detecting a defectively inserted weft thread;

said control means including a stopping means arranged to stop the operation of the loom in a position that forms the shed into which the weft thread is defectively inserted in response to the weft monitor detecting a defectively inserted weft thread;

and said control means being associated with said ready supply means, said transfer means, said main jet nozzle and said auxiliary jet nozzles to control said transfer means to take up a predetermined length of weft thread from said ready supply sequentially in several length segments, to control said main jet nozzle to insert each segment of weft thread into the shed, and to control said auxiliary jet nozzles to blow each inserted segment together with the defectively inserted weft thread through the shed in response to the weft monitor detecting a defectively inserted weft thread, said transfer means comprising a pre-blow nozzle arranged to blow weft thread in a first direction from said already supply means to said main jet nozzle, and to selectively blow weft thread in a second direction opposite to said first direction in response to said weft monitor detecting a defectively inserted weft thread.

* * * * *